US006997101B2

(12) United States Patent
Lyu

(10) Patent No.: US 6,997,101 B2
(45) Date of Patent: Feb. 14, 2006

(54) RECIPROCATING COMPRESSOR WITH A PRESSED FIT BUSHING

(75) Inventor: Yong Gyu Lyu, Gwangju (KR)

(73) Assignee: Samsung Gwangju Electronics Co., Ltd., Kwangju (KR)

( * ) Notice: Subject to any disclaimer, the term of this patent is extended or adjusted under 35 U.S.C. 154(b) by 122 days.

(21) Appl. No.: 10/814,361

(22) Filed: Mar. 31, 2004

(65) Prior Publication Data

US 2005/0115403 A1 Jun. 2, 2005

(30) Foreign Application Priority Data

Nov. 28, 2003 (KR) ..... 10-2003-0085737

(51) Int. Cl.
*F01B 9/00* (2006.01)

(52) U.S. Cl. ..... 92/140; 384/296; 384/906

(58) Field of Classification Search ..... 384/296, 384/906; 92/140

See application file for complete search history.

(56) References Cited

U.S. PATENT DOCUMENTS 2,989,354 A * 6/1961 Merriman ..... 384/296

FOREIGN PATENT DOCUMENTS

KR 10-02758770000 9/2000

OTHER PUBLICATIONS

Patent Abstract of Korean 10-0275877 Published Sep. 25, 2000.

* cited by examiner

*Primary Examiner*—F. Daniel Lopez
(74) *Attorney, Agent, or Firm*—Ladas & Parry

(57) ABSTRACT

A reciprocating compressor is capable of preventing a bush, provided between an eccentric shaft and an eccentric shaft mounting hole of a connecting rod, from being deformed. The reciprocating compressor includes a rotating shaft rotated by a drive unit which generates a rotating force. An eccentric shaft is eccentrically rotated by the rotating shaft. A piston reciprocates by a force transmitted from the eccentric shaft, thus compressing a refrigerant. A connecting rod has, on an end thereof, an eccentric shaft mounting hole so that the eccentric shaft is mounted to the end of the connecting rod, and converts a rotating motion of the eccentric shaft into a reciprocating motion to reciprocate the piston. A bush is placed between the eccentric shaft mounting hole and the eccentric shaft to fill a space between the eccentric shaft mounting hole and the eccentric shaft, with a hinge hole being provided at a predetermined portion of the bush to allow the eccentric shaft to be rotatably fitted into the hinge hole. A fitting recess is provided on one of the eccentric shaft mounting hole and the bush, and a fitting projection is provided on a remaining one of the eccentric shaft mounting hole and the bush to engage with the fitting recess through a press-fitting process.

4 Claims, 3 Drawing Sheets

RECIPROCATING COMPRESSOR WITH A PRESSED FIT BUSHING

CROSS-REFERENCE TO RELATED APPLICATION

This application claims the benefit of Korean Patent Application No. 2003-85737, filed Nov. 28, 2003 in the Korean Intellectual Property Office, the disclosure of which is incorporated herein by reference.

BACKGROUND OF THE INVENTION

1. Field of the Invention

The present invention relates, in general, to reciprocating compressors and, more particularly, to a reciprocating compressor, which is provided with a connecting rod to connect a rotating shaft to a piston.

2. Description of the Related Art

Generally, a reciprocating compressor is a machine that compresses a refrigerant in a hermetic space, prior to discharging the refrigerant to an outside of the compressor. The reciprocating compressor includes a hermetic casing. A compressing unit to compress the refrigerant, and a drive unit to drive the compressing unit are installed in the hermetic casing.

The compressing unit includes a cylinder block, a cylinder head, and a piston. The cylinder block defines a compression chamber to compress the refrigerant. The cylinder head is mounted to an end of the cylinder block, and includes a suction chamber to guide the refrigerant into the compression chamber, and an exhaust chamber to guide the compressed refrigerant from the compression chamber to an outside of the hermetic casing. The piston rectilinearly reciprocates in the compression chamber.

The drive unit includes a stator, a rotor, and a rotating shaft. When an electric power is applied to the stator, the stator generates an electromagnetic field. The rotor is rotated by the electromagnetic field generated along the stator. The rotating shaft is axially press-fitted into a center of the rotor to integrally rotate along with the rotor. Further, an eccentric shaft is integrally provided on a predetermined portion of the rotating shaft, and eccentrically rotates. A connecting rod is provided between the eccentric shaft and the piston to convert an eccentric rotating motion of the eccentric shaft into a reciprocating motion, thus reciprocating the piston.

An eccentric shaft mounting hole is provided on a predetermined portion of the connecting rod to allow the eccentric shaft to pass through the connecting rod. The eccentric shaft mounting hole is larger than an outer diameter of the eccentric shaft, thus allowing the eccentric shaft to be easily mounted in the eccentric shaft mounting hole. After the eccentric shaft is mounted in the eccentric shaft mounting hole of the connecting rod, a bush is fitted into a space between the eccentric shaft and the eccentric shaft mounting hole to fill the space, thus allowing an eccentric rotating force of the eccentric shaft to be stably transmitted to the connecting rod.

However, in the conventional reciprocating compressor, the bush is press-fitted into the eccentric shaft mounting hole of the connecting rod. Thus, the conventional reciprocating compressor has a problem in that a force acts on the bush while press-fitting the bush into the eccentric shaft mounting hole, so that the bush may be compressed in a radial direction thereof, and friction may occur between compressed parts of the bush and the eccentric shaft, thus hindering the rotation of the eccentric shaft.

SUMMARY OF THE INVENTION

Accordingly, it is an aspect of the present invention to provide a reciprocating compressor, which is capable of preventing a bush from being deformed while the bush is press-fitted into an eccentric shaft mounting hole of a connecting rod.

Additional aspects and/or advantages of the invention will be set forth in part in the description which follows and, in part, will be obvious from the description, or may be learned by practice of the invention.

The above and/or other aspects are achieved by a reciprocating compressor, including a rotating shaft, an eccentric shaft, a piston, a connecting rod, a bush, a fitting recess, and a fitting projection. The rotating shaft is rotated by a drive unit which generates a rotating force. The eccentric shaft is eccentrically rotated by the rotating shaft. The piston reciprocates by a force transmitted from the eccentric shaft, thus compressing a refrigerant. The connecting rod has, on an end thereof, an eccentric shaft mounting hole so that the eccentric shaft is mounted to the end of the connecting rod, and the connecting rod converts a rotating motion of the eccentric shaft into a reciprocating motion to reciprocate the piston. The bush is placed between the eccentric shaft mounting hole and the eccentric shaft to fill a space between the eccentric shaft mounting hole and the eccentric shaft, with a hinge hole being provided at a predetermined portion of the bush to allow the eccentric shaft to be rotatably fitted into the hinge hole. The fitting recess is provided on one of the eccentric shaft mounting hole and the bush. The fitting projection is provided on a remaining one of the eccentric shaft mounting hole and the bush to correspond to the fitting recess, and the fitting projection engages with the fitting recess through a press-fitting process.

According to an aspect of the invention, the bush and the eccentric shaft mounting hole may be provided so that an outer diameter of the bush and an inner diameter of the eccentric shaft mounting hole are determined to provide a sliding allowance, thus allowing the bush to slide in the eccentric shaft mounting hole. The fitting projection and the fitting recess may be provided so that sizes of the fitting projection and the fitting recess are determined to provide a fitting allowance, thus allowing the fitting projection to be press-fitted into the fitting recess, and allowing the bush to be press-fitted into the eccentric shaft mounting hole through an engagement of the fitting projection with the fitting recess.

In another aspect of this embodiment, the fitting projection and the fitting recess may be provided so that an end surface of the fitting projection and an inner end surface of the fitting recess are determined to provide the sliding allowance, and both side surfaces of the fitting projection and both inner side surfaces of the fitting recess are determined to provide the fitting allowance.

In yet another aspect of this embodiment, the fitting recess may include a plurality of fitting recesses provided around the bush or the eccentric shaft mounting hole at regular intervals, and the fitting projection may include a plurality of fitting projections provided around the remaining one of the bush and the eccentric shaft mounting hole at regular intervals.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
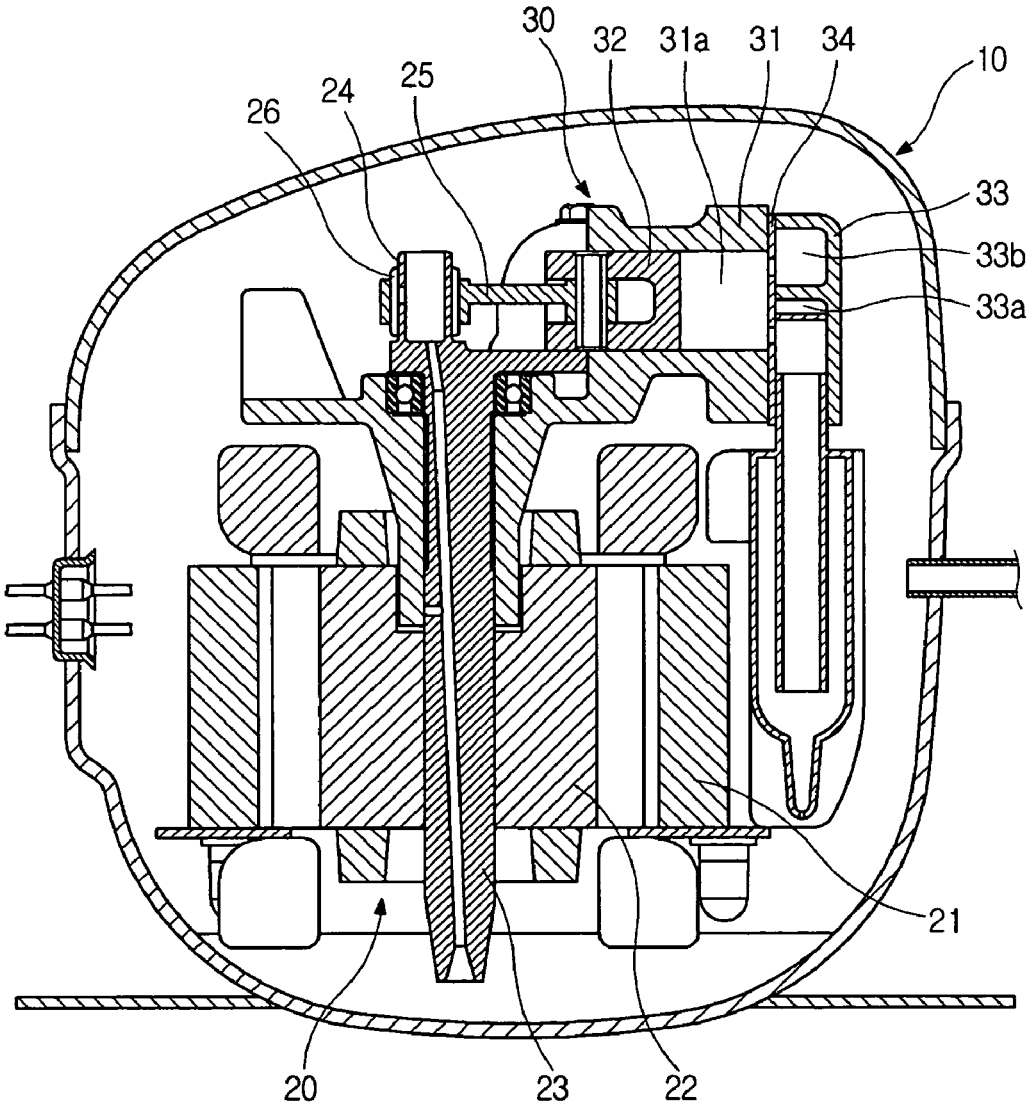
FIG. 1 is a sectional view of a reciprocating compressor, according to an embodiment of the present invention.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

As shown in FIG. 1, a reciprocating compressor according to the present invention includes a hermetic casing 10 to define an external appearance of the reciprocating compressor, with a drive unit 20 and a compressing unit 3 being installed in the hermetic casing 10. The drive unit 20 generates a power, and the compressing unit 30 compresses a refrigerant using the power of the drive unit 20.

The compressing unit 30 includes a cylinder block 31, a piston 32, and a cylinder head 33. The cylinder block 31 defines a compression chamber 31*a* therein. The piston 32 is received in the compression chamber 31*a*, and reciprocates in the compression chamber 31*a* to draw, compress, and discharge the refrigerant. The cylinder head 33 is mounted to an end of the compression chamber 31*a*, and includes a suction chamber 33*a* to guide the refrigerant into the compression chamber 31*a*, and an exhaust chamber 33*b* to guide the refrigerant from the compression chamber 31*a* to an outside of the hermetic casing 10. A valve plate 34 is interposed between the cylinder block 31 and the cylinder head 33 to draw or discharge the refrigerant into or from the compression chamber 31*a*, according to a pressure of the compression chamber 31*a*.

The drive unit 20 includes a stator 21 installed in the hermetic casing 10. A rotor 22 is set in the stator 21, and is rotated by an electromagnetic field generated along the stator 21 when an electric power is applied to the stator 21, thus generating a rotating force. A rotating shaft 23 penetrates the cylinder block 31 to transmit the rotating force from the rotor 22 to the compressing unit 30. An eccentric shaft 24 is provided on an end of the rotating shaft 23 to be eccentric from a central axis of the rotating shaft 23. The drive unit 20 also includes a connecting rod 25. The connecting rod 25 is rotatably mounted, at a first end thereof, to the eccentric shaft 24, and is hinged, at a second end thereof, to the piston 32. Thus, the connecting rod 25 converts a rotating motion of the eccentric shaft 24 into a rectilinear reciprocating motion to reciprocate the piston 32.

Figure 2:
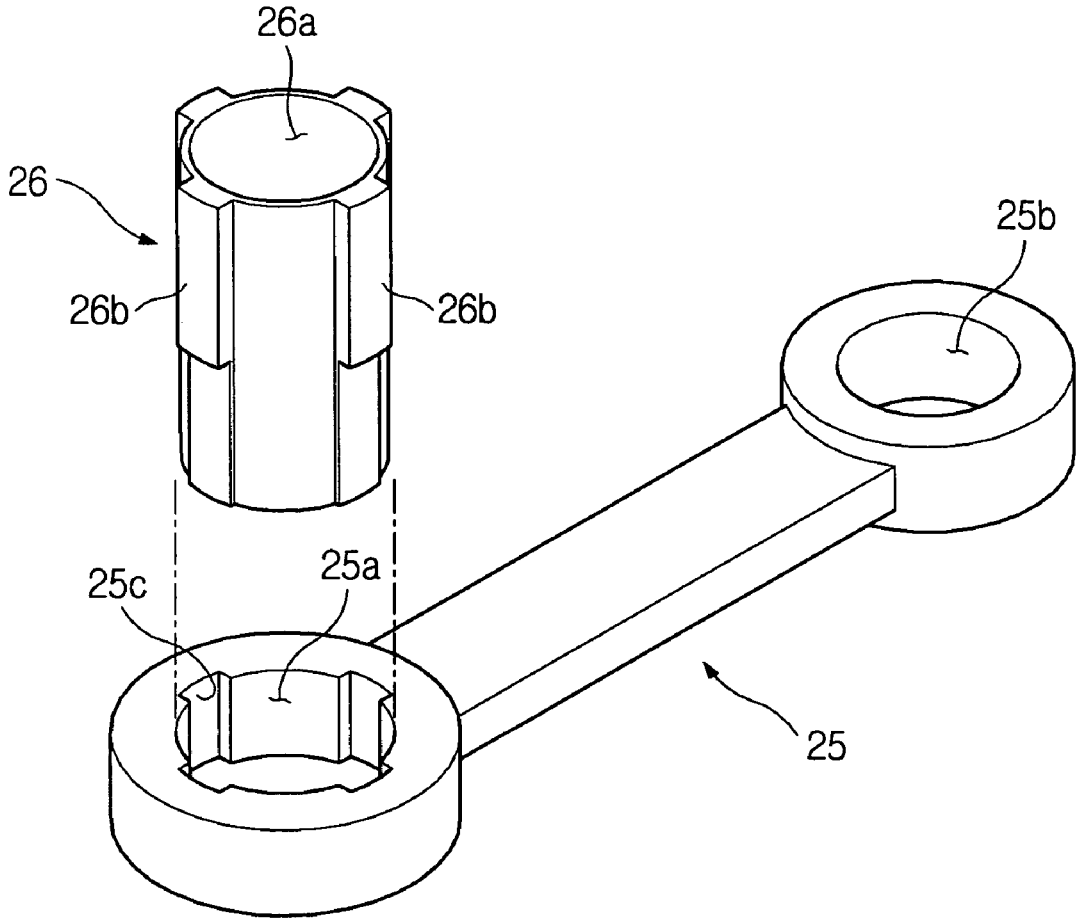
FIG. 2 is a perspective view of a connecting rod and a bush included in the reciprocating compressor of FIG. 1.

As shown in FIG. 2, according to an embodiment of the present invention, an eccentric shaft mounting hole 25*a* and a piston mounting hole 25*b* are respectively provided on opposite ends of the connecting rod 25 so that the eccentric shaft 24 and the piston 32 are respectively mounted to the opposite ends of the connecting rod 25. In this case, the eccentric shaft mounting hole 25*a* is larger than the eccentric shaft 24 so that the eccentric shaft 24 is easily mounted in the eccentric shaft mounting hole 25*a*. After the eccentric shaft 24 is mounted in the eccentric shaft mounting hole 25*a*, a bush 26 is fitted into a space between the eccentric shaft 24 and the eccentric shaft mounting hole 25*a*. The bush 26 fills the space between an inner circumferential surface of the eccentric shaft mounting hole 25*a* and an outer circumferential surface of the eccentric shaft 24, thus allowing a rotating force of the eccentric shaft 24 to be stably transmitted to the connecting rod 25.

The bush 26 of a cylindrical shape has a hinge hole 26*a* at a center thereof, so that the eccentric shaft 24 is rotatably fitted into the hinge hole 26*a*. In this case, the bush 26 is press-fitted into the eccentric shaft mounting hole 25*a* of the connecting rod 25.

In order to prevent the bush 26 from being compressed in a radial direction thereof by a force generated when the bush 26 is press-fitted into the eccentric shaft mounting hole 25*a*, an outer diameter of the bush 26 and an inner diameter of the eccentric shaft mounting hole 25*a* are determined to provide a sliding allowance, thus allowing the bush 26 to slide in the eccentric shaft mounting hole 25*a*. Fitting projections 26*b* are provided on one of the bush 26 and the eccentric shaft mounting hole 25*a*, while fitting recesses 25*c* are provided on a remaining one of the bush 26 and the eccentric shaft mounting hole 25*a*, so that the fitting projections 26*b* engage with the corresponding fitting recesses 25*c* through a press-fitting process. Thereby, most of force, generated when the bush 26 is press-fitted into the eccentric shaft mounting hole 25*a* of the connecting rod 25, acts on only the fitting projections 26*b* and the fitting recesses 25*c*.

According to an embodiment, a plurality of fitting projections 26*b* are provided on an outer circumferential surface of the bush 26 at regular intervals. Further, a plurality of fitting recesses 25*c* are provided on an inner circumferential surface of the eccentric shaft mounting hole 25*a*, at regular intervals, to correspond to the plurality of fitting projections 26*b*, so that the fitting projections 26*b* engage with the fitting recesses 25*c* through the press-fitting process. In this case, the fitting projections 26*b* and the fitting recesses 25*c* are provided so that sizes of the fitting projections 26*b* and the fitting recesses 25*c* are determined to provide a fitting allowance, thus allowing the fitting projections 26*b* to be press-fitted into the fitting recesses 25*c*.

Further, an end surface of each of the fitting projections 26*b* is provided to correspond to an inner end surface of each of the fitting recesses 25*c*. Both side surfaces of each of the fitting projections 26*b* are provided to correspond to both inner side surfaces of each of the fitting recesses 25*c*. In this case, the end surface of each of the fitting projections 26*b* and the inner end surface of each of the fitting recesses 25*c* are determined to provide the sliding allowance. The both side surfaces of each of the fitting projections 26*b* and the both inner side surfaces of each of the fitting recesses 25*c* are determined to provide the fitting allowance. Thus, most of the force generated when the bush 26 is press-fitted acts on the both side surfaces of the fitting projections 26*b* and the both inner side surfaces of the fitting recesses 25*c*.

Figure 3:
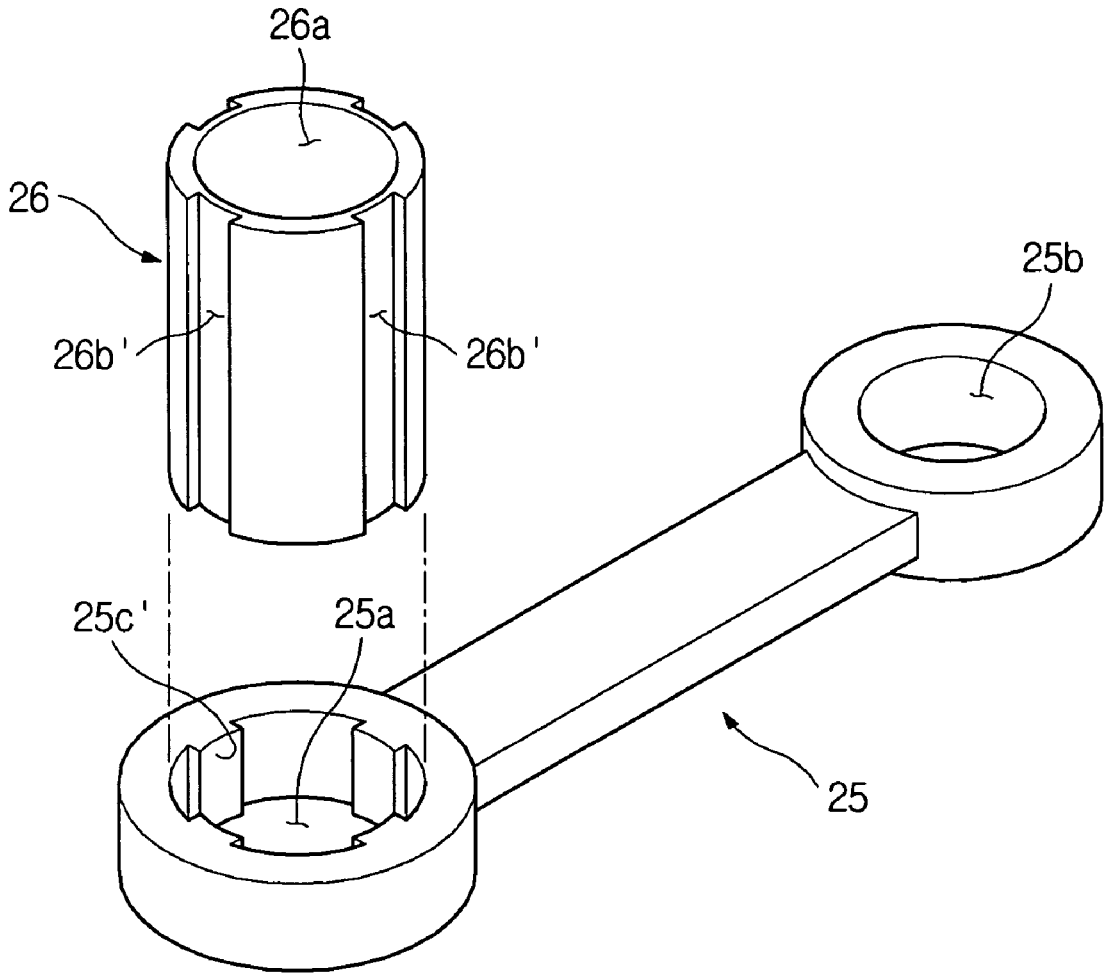
FIG. 3 is a perspective view of a connecting rod and a bush of a reciprocating compressor, according to another embodiment of the present invention.

According to an embodiment, the fitting projections 26*b* are provided on the bush 26, while the fitting recesses 25*c* are provided on the eccentric shaft mounting hole 25*a*. However, as shown in FIG. 3, fitting recesses 26*b*' may be provided on the bush 26, while fitting projections 25*c*' may be provided on the eccentric shaft mounting hole 25*a*.

The assembly process and operational effect of the connecting rod of the reciprocating compressor according to the present invention will be described in the following.

First, the piston 32 is hinged to the piston mounting hole 25*b* of the connecting rod 25, and then is inserted into the compression chamber 31*a* provided on the cylinder block 31. Subsequently, the rotating shaft 23 is installed to penetrate the cylinder block 31, and the eccentric shaft 24 provided on an end of the rotating shaft 23 is installed in the eccentric shaft mounting hole 25*a*. In this case, the inner diameter of the eccentric shaft mounting hole 25*a* is sufficiently larger than the outer diameter of the eccentric shaft 24, thus allowing the eccentric shaft 24 to be easily installed in the eccentric shaft mounting hole 25*a*.

In such a state, the bush 26 is press-fitted into the eccentric shaft mounting hole 25*a*. The eccentric shaft 24 is rotatably installed in the hinge hole 26*a* of the bush 26, and the space between the eccentric shaft 24 and the inner circumferential surface of the eccentric shaft mounting hole 25*a* is filled with the bush 26. Thereby, the eccentric rotating motion of the eccentric shaft 24 is stably converted into the reciprocating motion to reciprocate the piston 32.

In this case, the bush 26 is provided to have the sliding allowance relative to the inner circumferential surface of the eccentric shaft mounting hole 25*a*, so that the bush 26 is press-fitted into the eccentric shaft mounting hole 25*a* through engagement of the fitting recesses 25*c* and the fitting projections 26*b*. Further, the both side surfaces of each of the fitting projections 26*b* and the both inner side surfaces of each of the fitting recesses 25*c* are determined to provide the fitting allowance, so that only the both side surfaces of each of the fitting projections 26*b* are press-fitted into the both inner side surfaces of each of the fitting recesses 25*c*. Thereby, most of the force, acting on the fitting projections 26*b* when the bush 26 is press-fitted into the eccentric shaft mounting hole 25*a*, acts on the both side surfaces of each of the fitting projections 26*b* in a circumferential direction. Thus, the force which acts on the fitting projections 26*b* is offset, and the bush 26 is prevented from being compressed in a radial direction of the bush 26.

As is apparent from the above description, the present invention provides a reciprocating compressor, which is constructed so that a bush provided between an eccentric shaft and a connecting rod is press-fitted into an eccentric shaft mounting hole of the connecting rod through engagement of both inner side surfaces of a fitting recess with both side surfaces of a fitting projection, thus causing force generated when the bush is press-fitted to act in a circumferential direction and thereby being offset, therefore preventing a bush from being compressed in a radial direction thereof.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A reciprocating compressor, comprising:

a rotating shaft rotated by a drive unit which generates a rotating force;

an eccentric shaft eccentrically rotated by the rotating shaft;

a piston to reciprocate by a force transmitted from the eccentric shaft, thus compressing a refrigerant;

a connecting rod having, on an end thereof, an eccentric shaft mounting hole so that the eccentric shaft is mounted to the end of the connecting rod, the connecting rod converting a rotating motion of the eccentric shaft into a reciprocating motion to reciprocate the piston;

a bush placed between the eccentric shaft mounting hole and the eccentric shaft to fill a space between the eccentric shaft mounting hole and the eccentric shaft, with a hinge hole being provided at a predetermined portion of the bush to allow the eccentric shaft to be rotatably fitted into the hinge hole;

a fitting recess provided on one of the eccentric shaft mounting hole and the bush; and a fitting projection provided on a remaining one of the eccentric shaft mounting hole and the bush to correspond to the fitting recess, the fitting projection engaging with the fitting recess through a press-fitting process.

2. The reciprocating compressor according to claim 1, wherein the bush and the eccentric shaft mounting hole are provided so that an outer diameter of the bush and an inner diameter of the eccentric shaft mounting hole are determined to provide a sliding allowance, thus allowing the bush to slide in the eccentric shaft mounting hole, and the fitting projection and the fitting recess are provided so that sizes of the fitting projection and the fitting recess are determined to provide a fitting allowance, thus allowing the fitting projection to be press-fitted into the fitting recess, and allowing the bush to be press-fitted into the eccentric shaft mounting hole through an engagement of the fitting projection with the fitting recess.

3. The reciprocating compressor according to claim 2, wherein the fitting projection and the fitting recess are provided so that an end surface of the fitting projection and an inner end surface of the fitting recess are determined to provide the sliding allowance, and both side surfaces of the fitting projection and both inner side surfaces of the fitting recess are determined to provide the fitting allowance.

4. The reciprocating compressor according to claim 1, wherein the fitting recess comprises a plurality of fitting recesses provided around the bush or the eccentric shaft mounting hole at regular intervals, and the fitting projection comprises a plurality of fitting projections provided around the remaining one of the bush and the eccentric shaft mounting hole at regular intervals.

* * * * *